United States Patent [19]

Jauch

[11] 4,036,005

[45] July 19, 1977

[54] CLOCK WITH HOUR AND QUARTER HOUR STRIKING MECHANISM

[75] Inventor: Christian M. J. Jauch, Louisville, Miss.

[73] Assignee: Spartus Corporation, Chicago, Ill.

[21] Appl. No.: 697,440

[22] Filed: June 18, 1976

Related U.S. Application Data

[63] Continuation-in-part of Ser. No. 671,143, March 29, 1976.

[51] Int. Cl.[2] ..... G04B 21/00; G04B 19/02

[52] U.S. Cl. ..... 58/9; 58/125 R

[58] Field of Search ..... 58/8–13, 58/125 R

[56] References Cited

U.S. PATENT DOCUMENTS

| | | | |
|---|---|---|---|
| 1,531,108 | 3/1925 | Lehmann | 58/8 |
| 2,127,635 | 8/1938 | Warshawsky | 58/8 |
| 2,851,850 | 9/1958 | Fowler | 58/13 |
| 3,520,126 | 7/1970 | Kolodziej | 58/8 |

FOREIGN PATENT DOCUMENTS

| | | | |
|---|---|---|---|
| 1,221,989 | 7/1966 | Germany | 58/9 |

*Primary Examiner*—E. S. Jackmon

*Attorney, Agent, or Firm*—Merriam, Marshall, Shapiro & Klose

[57] ABSTRACT

Clock with mechanism for striking one two-note tone on the quarter hour, two two-note tones on the half hour, three two-note tones on the three quarter hour and, on the hour, a single note tone corresponding to the particular hour indicated. A latch and rack structure control the number of strikes at quarterly fractions of the hour and the rack and a snail cam control the number of strikes at the hour.

15 Claims, 11 Drawing Figures

CLOCK WITH HOUR AND QUARTER HOUR STRIKING MECHANISM

RELATED CASE

This is a continuation-in-part of application Ser. No. 671,143, filed Mar. 29, 1976 and entitled "Clock With Striking Mechanism", and the disclosure thereof is incorporated herein by reference.

BACKGROUND OF THE INVENTION

The present invention relates generally to clocks and more particularly to a clock having a striking mechanism which, at the hour, strikes a chime rod, bell or the like a predetermined number of times corresponding to the particular hour position of the clock's hour hand and which also strikes at each of the three quarterly fractions of the hour.

The above-noted parent application discloses a clock having a mechanism for striking the hour and the half-hour and which is relatively compact and has relatively inexpensive components. It is desirable to have a clock which also strikes at the quarter hour and three quarter hour positions of the clock's minute hand. Generaly, clocks which strike at all three quarterly hour positions of the minute hand (i.e., quarter hour, half hour and three quarter hour) as well as striking, at the hour, the number indicated by the clock's hour hand, have utilized striking mechanisms which are relatively complicated and expensive, such as what is known as a "Westminster Chime".

SUMMARY OF THE INVENTION

The present invention is a modification of the Clock With Striking Mechanism disclosed in said parent application and embodies the relative simplicity, compactness, and inexpensiveness of that clock. This has been accomplished by modifying some of the parts of that clock and adding a few new parts. However, the overall unit size is essentially the same. The complications and expensive components of the Westminster Chime are avoided.

In one embodiment, the mechanism strikes a two-note tone at the quarter hour, strikes this two-note tone twice at the second quarter (or half-hour) and strikes this same two-note tone three times at the three quarter hour. At the hour, a single note tone is struck as many times as is indicated by the hour hand.

Other features and advantages are inherent in the structure claimed and disclosed or will be apparent to those skilled in the art from the following detailed description in cojunction with the accompanying diagrammatic drawing.

DETAILED DESCRIPTION

Figure 1:
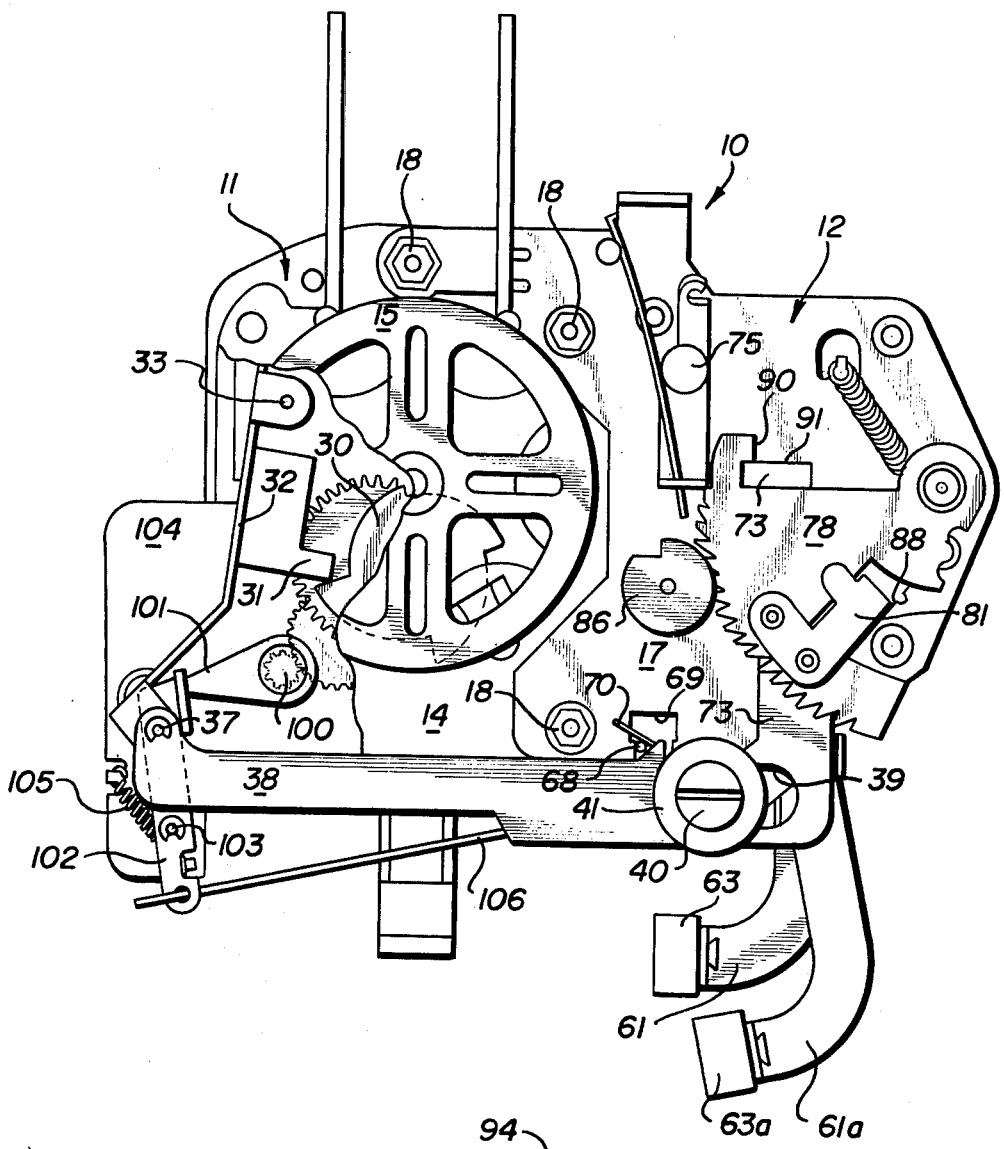
FIG. 1 is a rear view, partially cut away, of a clock having a striking mechanism constructed in accordance with an embodiment of the present invention.
Figure 7:
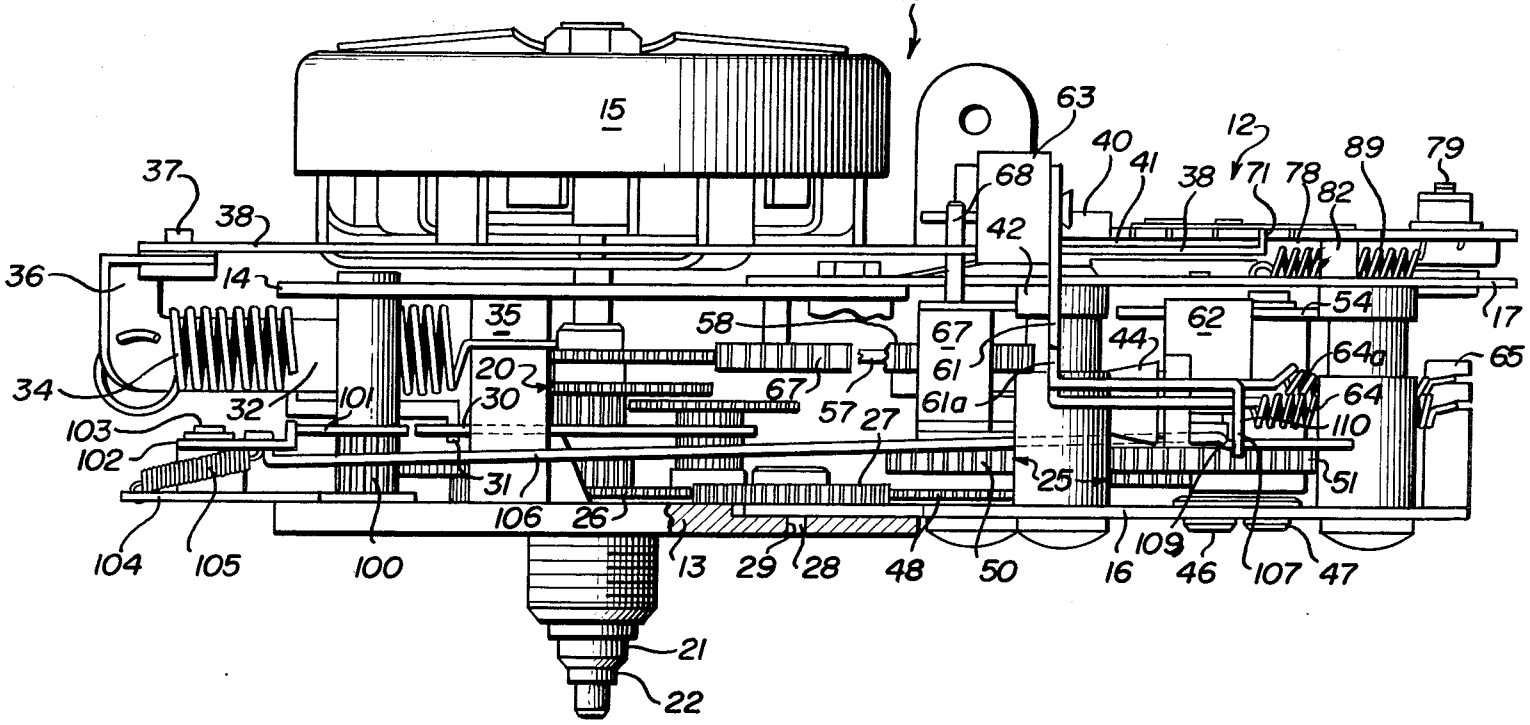
FIG. 7 is a side view of the entire clock and striking mechanism.

Referring initially to FIGS. 1 and 7, a clock indicated generally at 10 comprises a clock mechanism 11 and a striking mechanism 12 separate and discrete from clock mechanism 11 and located alongside the clock mechanism. Clock mechanism 11 comprises front and rear plates 13, 14 respectively, and striking mechanism 12 comprises front and rear plates 16, 17 respectively. Fastening means 18 connect together the corresponding front and rear plates of the clock and striking mechanisms 11, 12.

Mounted on rear plate 14 of clock mechanism 11 is a synchronous electric motor 15 of conventional construction powered by conventional 60-cycle AC current, for example. Motor 15 drives first gear means 20 located on clock mechanism 11 between front and rear plates 13, 14 thereof. Gear means 20 in turn drives hour hand shaft 21 and minute hand shaft 22 both located in front of front plate 13 of clock mechanism 11 (FIG. 7).

Mounted on striking mechanism 12, between front and rear plates 16, 17 thereof, are second gear means indicated generally at 25. Located on clock mechanism 11 is a further gear 26 which, by virtue of being driven through first gear means 20 by synchronous electric motor 15, rotates continuously at a constant speed. Located on striking mechanism 12 as part of second gear means 25 is a linking gear 27 which meshes with gear 26 on clock mechanism 11.

Structure is provided to assure an accurate meshing engagement of linking gear 27 with continuously rotating gear 26 when the striking mechanism 12 is attached to the clock mechanism 11 in side-by-side relation. This structure comprises a pin 28 mounted on the striking mechanism's front plate 16 and an opening 29 in the clock mechanism's front plate 13. Pin 28 is received in opening 29 when the two mechanisms are assembled together and, in effect, constitutes an axis of rotation for a gear on the clock mechanism and an axis of rotation for a gear on the striking mechanism, the axis of rotation on both mechanisms being identical in this particular case. In this manner, second gear means 25 on striking mechanism 12 is correctly located in relation to first gear means 20 on clock mechanism 11.

Figure 2:
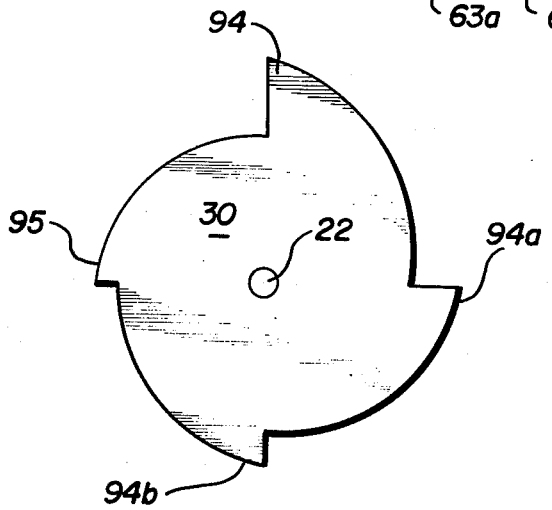
FIG. 2 is a front view of the clock's minute hand shaft and a cam mounted thereo.

Fastened to minute hand shaft 22 so as to rotate with it, is a cam 30 consisting of four steps 94, 94*a*, 94*b* and 95 (FIGS. 1 and 2). The cam steps are 90° apart, each step corresponding to a 15 minute period or one of the four quarterly hour positions of the minute hand on the clock dial. Each step is slightly higher than the preceding step with step 95 being the shortest and corresponding to the first quarter-hour, step 94*b* being slightly higher and corresponding to the half-hour, step 94*a* being slightly higher than step 94*b* and corresponding to the three quarter hour and step 94 being the highest step, slightly higher than step 94*a*, and corresponding to the hour.

Riding against cam 30 is a cam follower 31 attached to a lever 32 having one end pivoting on a pin 33 mounted to clock mechanism front plate 13. Cam follower 31 is held against cam 30 by the urging of a spring 34 having one end engaging the end 36 of lever 32 opposite pin 33 and another end attached to a post 35.

Lever end 36 carries a pin 37 on which is pivotally mounted one end of a slide member 38 having a horizontally elongated slot 39 at its other end. Slide member 38 is retained alongside striking mechanism 12 by a shoulder screw 40 extending through a washer 41 and slot 39 into a threaded opening in a post 42 located between front and rear plates 16, 17 of striking mechanism 12.

As cam 30 rotates with the minute hand shaft, lever 32 moves outward, to the left in FIG. 1, carrying slide member 38 with it.

Figure 5:
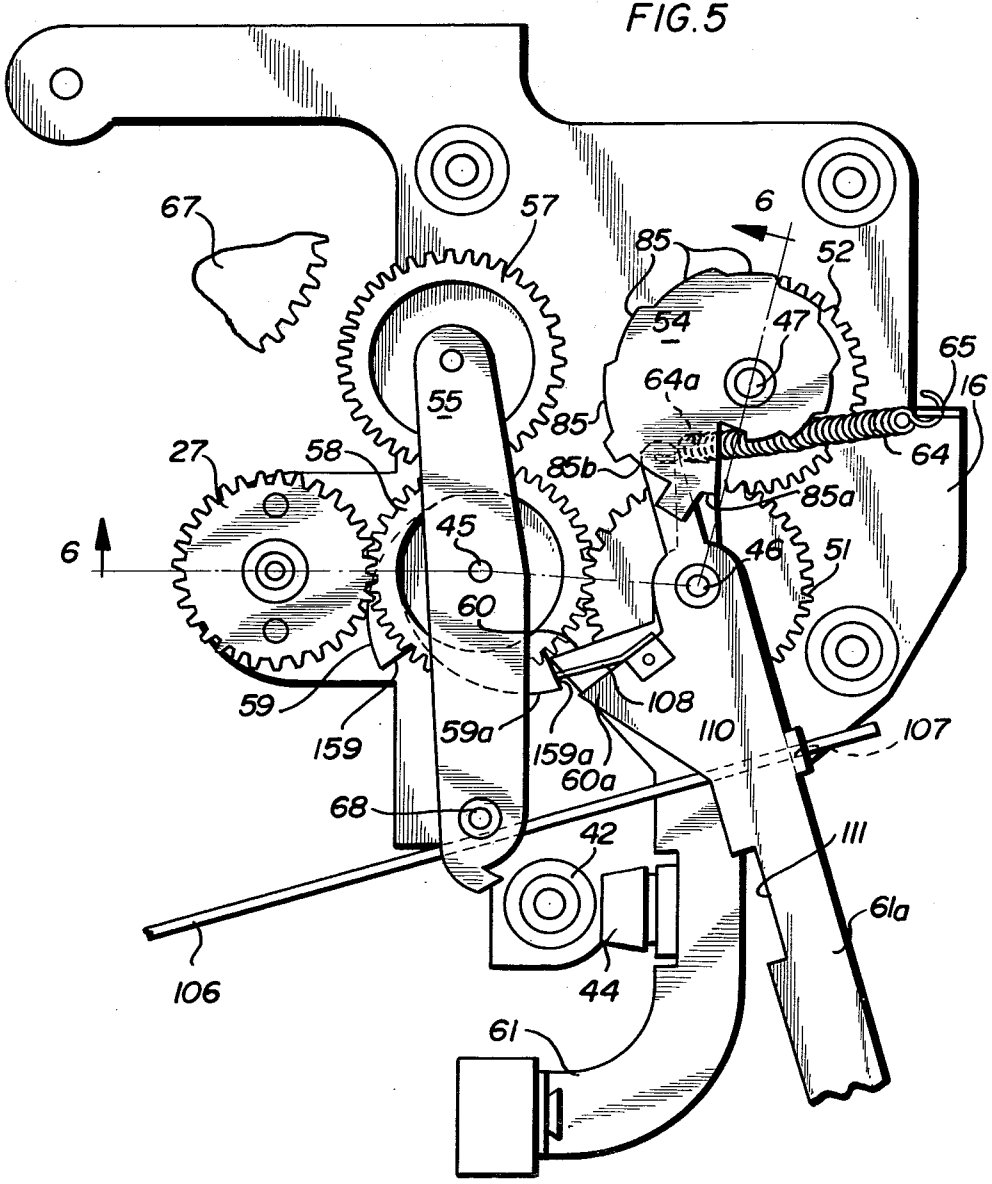
FIG. 5 is a rear view of the striking mechanism with some of its parts removed.
Figure 4:
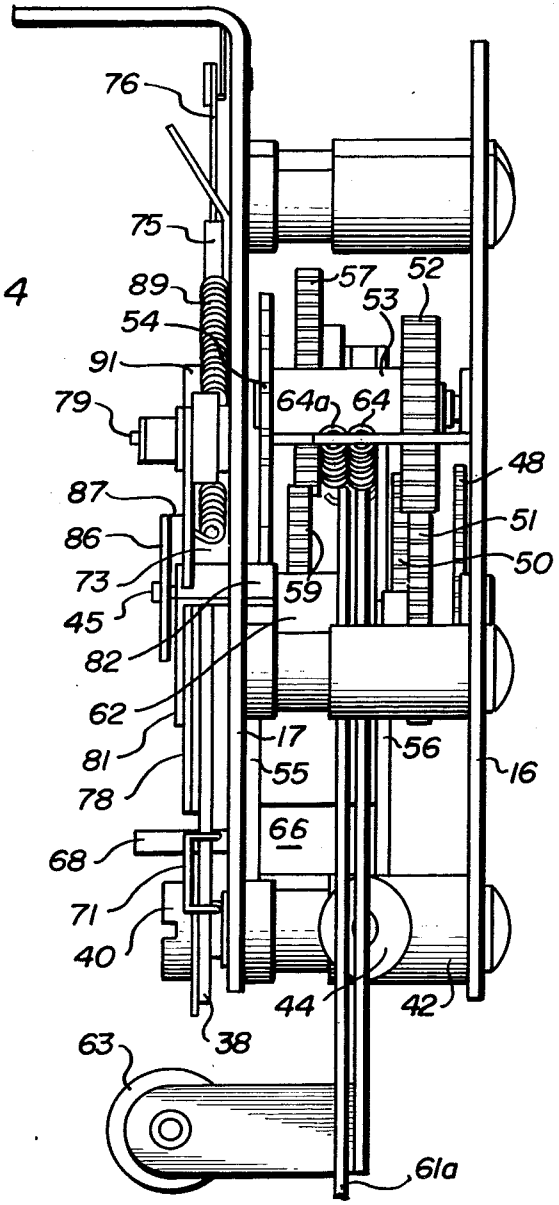
FIG. 4 is a side view of the striking mechanism.
Figure 6:
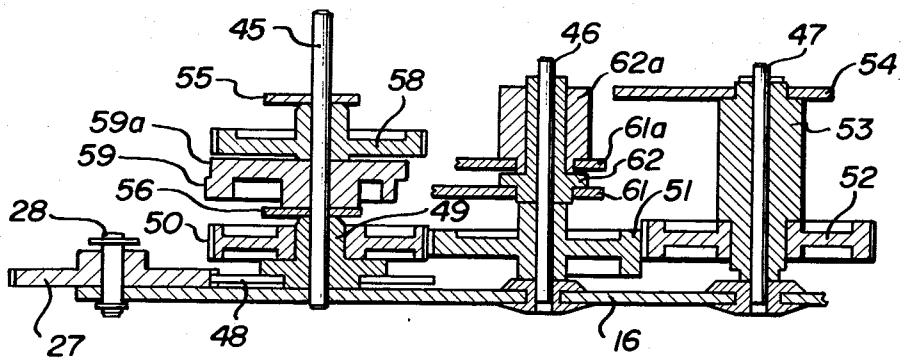
FIG. 6 is a sectional view taken along line 6—6 in FIG. 5.
Figure 9:
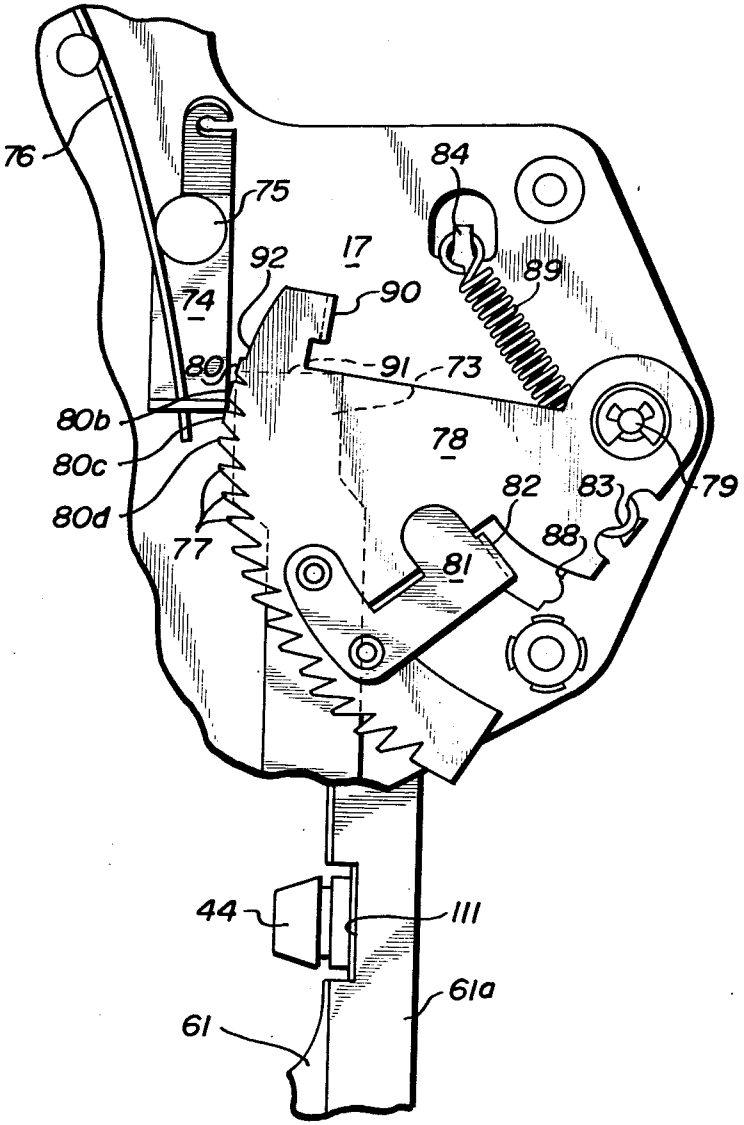
FIG. 9 is a partial rear view of the striking mechanism showing the disposition of some of its parts at the half hour.

Extending between the front and rear plates 16, 17 of striking mechanism 12 are three shafts 45, 46, 47 (FIGS. 5 and 6). Freely rotatable on shaft 45 is a gear 48 having a hub 49 on which is mounted a gear 50 rotatable with gear 48. Freely rotatable about shaft 46 is a gear 51, and freely rotatable about the axis of shaft 47 is a gear 52 fixed on a hub 53 on which is fixed a snail cam 54.

Linking gear 27 drives gear 48, hub 49 and gear 50 on shaft 45. Gear 50 drives gear 51 on shaft 46, and gear 51 drives gear 52, hub 53 and snail cam 54 on shaft 47.

Linking gear 27 is in mesh with the hour hand gear 26 of the clock mechanism. All of said gears 26, 27, 48, 50, 51, 52 are intermeshed and of such a ratio that as the clock mechanism runs, gear 52 and snail cam 54 rotate in step with, and at the same speed as, hour gear 26, i.e., one revolution in 12 hours.

Rotatably mounted on shaft 45 are a pair of vertically spaced arms 55, 56. Rotatably mounted between one end of arms 55, 56 is a gear 57 (FIG. 5). Also located between arms 55, 56 are a gear 58 and a pair of cams **59, 59*a* all fixed to shaft 45. The drop 159*a* on second cam 59*a* is spaced about 90° from the drop 159 on first cam 59.**

Gear 57 drives gear 58 which turns shaft 45 to drive cams **59, 59*a* which, on each rotation engage a respective projection 60, 60*a* on a respective striking lever or arm 61, 61*a*. Lever 61 is pivotally mounted on a hub or bushing 62 fixed on shaft 46, and lever 61*a* is attached to a hub or bushing 62*a* pivotally mounted on hub 62. Bushing 62*a* is free to turn about the bushing 62. As the cams 59 and 59*a* rotate in a clockwise direction as shown in FIG. 5 they raise and release first lever 61 and then lever 61*a* to swing the levers. Attached to lever extension 60*a* is a spring finger 108, the function of which will be subsequently described. One end of each striking lever 61, 61*a* carries a hammer 63, 63*a* for striking a respective chime rod or the like (not shown), each having a different tone. The other end of each striking lever 61, 61*a* is attached to one end of a spring 64, 64*a* having its other end attached to a tab 65 on front plate 16 of the striking mechanism. Striking levers 61, 61*a* pivot in a counterclockwise sense, as viewed in FIG. 5, at the urging of cams 59, 59*a* and then return in a clockwise sense due to the urging of springs 64, 64*a* once for every revolution of cams 59, 59*a*. A rubber bumper 44 on striking lever 61 bumps against post 42** on that striking lever's return movement.

Figure 3:
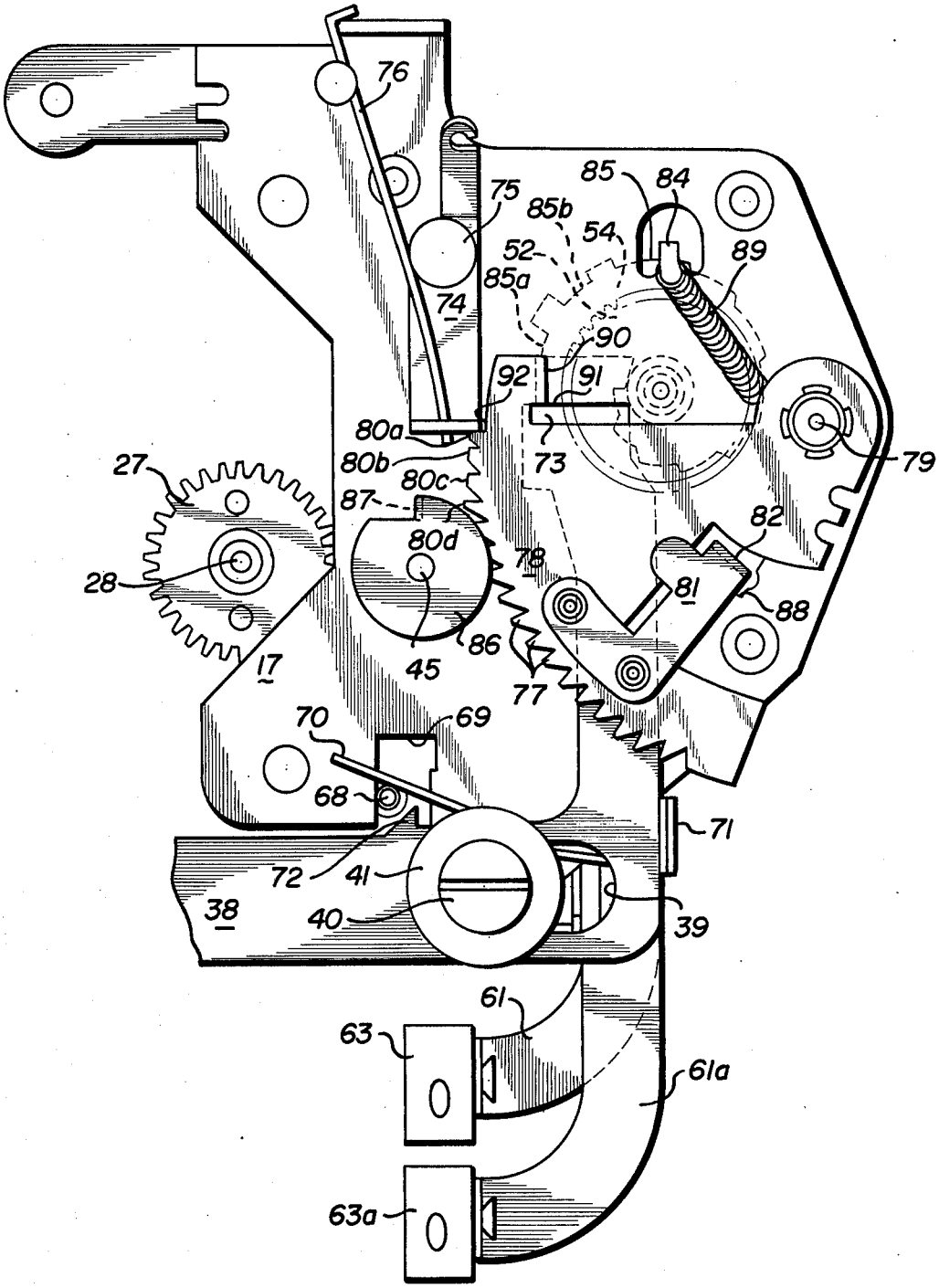
FIG. 3 is a rear view of the striking mechanism.

Located between arms 55, 56, at the ends thereof opposite gear 57, is a spacer plug 66 mounted on a pin 68. Arms 55, 56 are free to rotate about shaft 45 and, when rotated counterclockwise as viewed in FIG. 5, carry gear 57 into meshing engagement with a constantly rotating gear 67 in clock mechanism 11 (FIGS. 5 and 7). The amount that arms 55, 56 rotate is controlled by pin 68 which extends through a slot 69 (FIG. 3) cut into rear plate 17 of the striking mechanism. Arms 55, 56 and gear 57 are retained in a clockwise location as viewed in FIG. 5 (disengaged from constantly rotating gear 67) due to the urging of a spring finger 70 bearing against pin 68 (FIG. 3). Spring finger 70 has an end portion 71 attached to slide member 38.

As previously explained, cam 30 on the minute hand shaft causes lever 32 to move outwardly and thus move slide member 38 to the left, as viewed in FIG. 3. Because of the clearance between shoulder screw 40 and slot 39, slide member 38 is free to move up and down a small amount as viewed in FIG. 3. This movement of slide member 38 is sufficient to allow a projection 72 thereon to move under and to the left of pin 68 as slide member 38 moves to the left in FIG. 3.

When cam 30 has rotated sufficiently to cause follower 31 to fall off one of the cam steps **94, 94*a*, 94*b*, 95, lever 32 is moved to the right in FIG. 1, by the urging of spring 34, in turn moving slide member 38 to the right. Projection 72 now engages pin 68, pushing pin 68 to the right and rotating arms 55, 56 counterclockwise in FIG. 5 so as to mesh gear 57 with constantly rotating gear 67** on the clock mechanism.

Referring to FIGS. 3, and 8–11, an upward extension 73 of slide member 38 is positioned to contact a latch 74 pivotally mounted at 75 to rear plate 17. Latch 74 is normally urged by a spring 76 into engagement with the periphery of a rack 78 pivotally mounted at 79 to rear plate 17. Rack 78 is normally urged by a spring 89 to pivot in a clockwise sense in FIGS. 3, and 8–11, but such pivotal movement is prevented by the engagement of latch 74 with the rack's periphery comprising, in clockwise sequence, a plurality of full teeth 77, an enlarged tooth **80*d*, three partial teeth 80*c*, 80*b*, 80*a*, sequentially decreasing in size in a clockwise sense, and an untoothed portion 92.**

Figure 11:
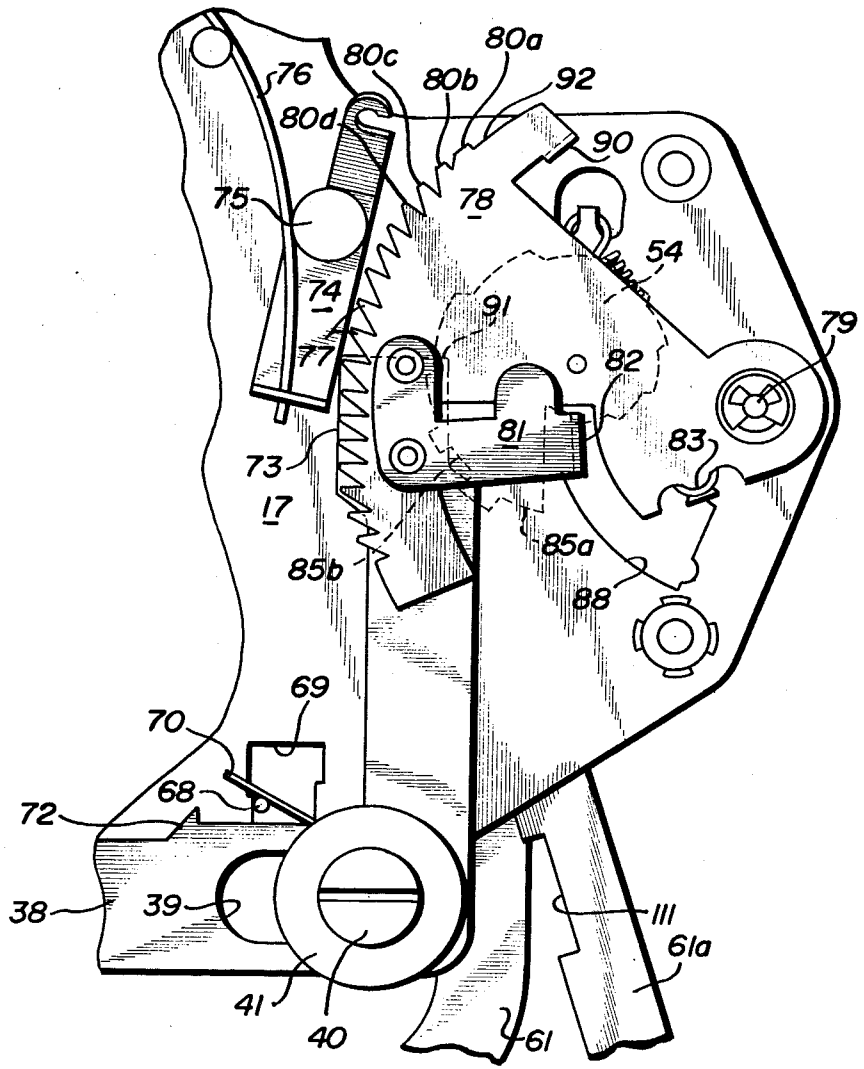
FIG. 11 is a partial rear view of the striking mechanism the disposition of some of its parts at 12 o'clock.
Figure 10:
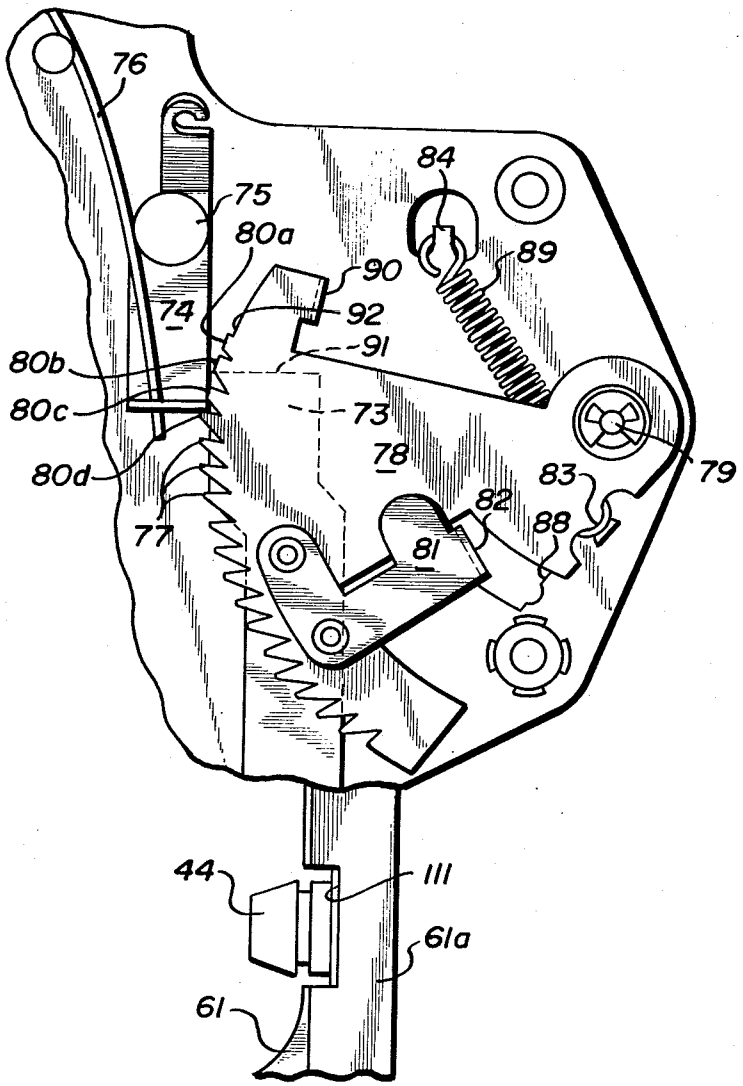
FIG. 10 is a partial rear view of the striking mechanism showing the disposition of some of its parts at the three quarter hour.

When slide member 38 moves to the left, as viewed in FIGS. 3 and 11, the slide member's upward extension 73 engages latch 74 and pivots the latch from rack-engaging positions at untoothed rack portion 92 (FIG. 3) or at one of the peripheral gear teeth **77, 80*a*–80*d* on rack 78 (FIGS. 8–10) to a disengaged position shown in FIG. 11.**

Rack 78 is mounted for movement about pivotal axis 79 between a first position shown in FIG. 3 and a plurality of positions displaced from the position of FIG. 3 in a clockwise sense. Four such displaced positions are shown in FIGS. 8–11. There are twelve displaced positions, in all: one for the quarter hour and 1 o'clock (FIG. 8), one for the half hour and 2 o'clock (FIG. 9), one for the three quarter hour and 3 o'clock (FIG. 10), and one for each of the nine remaining hour positions on the clock (the 12 o'clock position being shown in FIG. 11).

Figure 8:
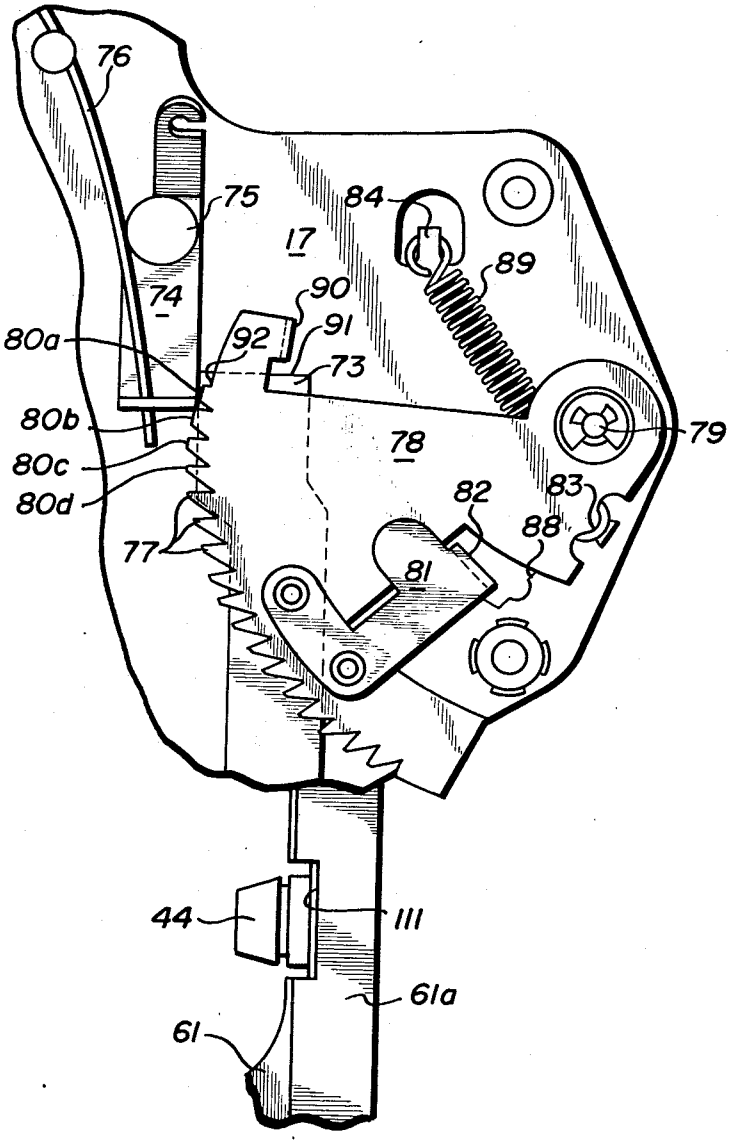
FIG. 8 is a partial rear view of the striking mechanism showing the disposition of some of its parts at the quarter-hour.

Rack 78 is urged in a clockwise sense, as viewed in FIGS. 3 and 8–11, by a spring 89 having one end attached to rack 78 at 83 and another end attached to a tab 84 on plate 17 (FIG. 8). Pivotal movement of rack 78 in a clockwise sense, upon complete disengagement of latch 74 from rack 78 (FIG. 11), is limited to a displaced position determined by the position of the hour hand shaft on the clock mechanism, utilizing structure now to be described.

Mounted on rack 78 is an element 81 (FIGS. 1, 3, and 8–11) from which depends a tab 82 extending through a slot 88 in plate 17 for engaging with one of twelve steps 85 on snail cam 54 (FIG. 5). As previously described, snail cam 54 is synchronized for movement with the hour hand shaft of the clock mechanism. Each of the steps 85 on snail cam 54 is spaced a different radial distance from the pivotal axis 47 of the snail cam. The cam step spaced the longest radial distance from pivotal axis 47 of snail cam 54 corresponds to a time of 1 o'clock for the hour hand, and the cam step spaced the shortest radial distance from the pivotal axis of the snail cam corresponds to a time of 12 o'clock for the hour hand. Snail cam 54 also includes a pair of peripheral indentations 85*a* (just counterclockwise of 1 o'clock step 85 in FIG. 3) and 85*b* (between the 1 o'clock and 2 o'clock steps 85), and the functions of these indentations will be subsequently described.

Pivotal movement of rack 78 in a clockwise sense is limited the most when tab 82 engages the step on snail cam 54 spaced the longest radial distance from the pivotal axis of the snail cam, and pivotal movement of rack 78 in a clockwise sense is limited the least when tab 82 engages the step on snail cam 54 spaced the least radial distance from the pivotal axis of the snail cam.

Rack 78 is returned, in a counterclockwise sense, to its first position (FIG. 3) by a disc 86 mounted on shaft 45 and having a tab 87 depending therefrom for engaging the full peripheral teeth 77 of rack 78 as disc 86 rotates in a clockwise sense with shaft 45, as viewed in FIG. 3. Each tie tab 87 engages one of the peripheral teeth 77 on rack 78, rack 78 rotates in a counterclockwise sense a distance equal to the space between two adjacent teeth 77 on the rack. Latch 74 is urged by spring 76 against rack teeth 77 and 80*a*–80*d* to prevent return rotation of the rack in a clockwise sense while tab 87 is disengaged from the rack teeth.

Disc 86 rotates with shaft 45. As previously explained, cams 59, 59*a* (for actuating striking levers 61, 61*a*) also rotate with shaft 45 in turn driven by gear 58 in turn driven by gear 57 mounted on arms 55, 56 which carry gear 57 into meshing engagement with the constantly rotating gear 67 on the clock mechanism when slide member 38 moves to the right (as viewed in FIGS. 1 and 3) and projection 72 on slide member 38 engages pin 68. Gear 57 is disengaged from meshing engagement with constantly rotating gear 67 by structure now to be described, and this, in turn, stops the operation of cams 59, 59*a* (operating striking levers 61, 61*a*) and disc 86 (rotating rack 78).

Referring to FIGS. 1 and 3, rack 78 has a depending tab 90. When rack 78 is pivoted counterclockwise until its untoothed peripheral portion 92 is in registry with latch 74, tab 90 engages the end 91 of upward extension 73 on slide member 38 causing the slide member to pivot downward about pin 37 (FIG. 1). This motion moves the slide member's projection 72 out of the path of pin 68 allowing spring finger 70 (FIG. 3) to rotate arms 55, 56 in a clockwise sense (FIG. 5), thereby moving attached gear 57 out of meshing engagement with constantly rotating clock gear 67 and preventing further rotation of gear 57. This, in turn, prevents further rotation of gear 58 and associated shaft 45, cams 59, 59*a* and disc 86.

Following is the sequence of operations which occur is striking the quarter hour. As minute hand shaft 22 rotates with cam 30 from zero to fifteen minutes, cam follower 31 climbs the shortest step 95 of cam 30 (FIG. 2). This pivots lever 32 in a clockwise sense and moves slide member 38 part way to the left (FIGS. 1 and 3). Such movement causes the slide member's upward extension 73 to pivot latch 74 away from untoothed portion 92 on rack 78 (FIG. 3) and out of engagement with the clockwise side of partial rack tooth 80*a*. When latch 74 moves free of rack tooth 80*a*, this allows rack 78 to rotate clockwise under the urging of spring 89. The cam rise 95 and the height of rack tooth 80*a* are such that slide extension 73 moves latch 74 only far enough to release tooth 80*a*, and further rotation of rack 78 is arrested by engagement of latch 74 with partial tooth 80*b*. Rack 78 is thus cocked to control the striking of the quarter hour.

When the minute hand shaft reaches fifteen minutes, follower 31 drops off short step 95 on cam 30, causing slide member 38 and its projection 72 to move to the right under the urging of spring 34 (FIGS. 1 and 3). Projection 72 engages pin 68 and pivots arms 55, 56 with gear 57 into meshing engagement with connstantly rotating gear 67 on the clock mechanism (FIG. 5). Through a linkage described above, gear 57 drives disc 86 and cams 59, 59*a* which rotate together. One rotation of cams 59, 59*a* raises and releases each of the striking levers 61, 61*a* once (FIG. 5). Referring to FIG. 2, one rotation of disc 86 brings tab 87 into engagement with a full tooth 77 on rack 78 to rotate rack 78 counterclockwise one tooth, thereby bringing latch 74 back to registry with untoothed portion 92 on rack 78.

When rack 78 has been rotated counterclockwise so that latch 74 is at untoothed portion 92 of rack 78, tab 90 on rack 78 pushes down on end 91 of the slide member's upward extension 73 (FIG. 3). This disengages projection 72 from pin 68 causing arms 55, 56 with gear 57 to be urged by spring 70, away from a position of meshing engagement of gear 57 with constantly rotating gear 67. Gear 57 thus (a) stops driving cams 59, 59*a* after one strike by striking levers 61, 61*a* and (b) stops driving disc 86 after one engagement thereof with a tooth 77 on rack 78. The levers 61 and 61*a* each strike a chime, gong or bell of a different tone, and each in turn strikes its individual note only once. This indicates the first quarter hour.

In striking the half hour, essentially the same sequence of operations occurs as occurred in the striking of the quarter hour (described above) except for the following differences. Cam follower 31 climbs step 94*b*, between the fifteen and thirty minute positions of the minute hand, to cock the mechanism for striking the half hour (FIG. 9), and drops off step 94*b* at the thirty minute position ot initiate the striking. Because step 94*b* is slightly higher than step 95, latch 74 is pivoted further away from rack 78 allowing rack teeth 80*a* and 80*b* to pass, rotation of rack 78 being arrested by engagement of latch 74 with slightly higher rack tooth 80*c*. Since two rack teeth have now passed by latch 74, cams 59 and 59*a* will make two complete revolutions before gear 57 is disengaged to stop rotation of these cams. Striking levers 61 and 61*a* will thus strike their respective gong or bell twice, and this indicates the second quarter or half hour.

In striking the three quarter hour, essentially the same sequence of operations occurs as occurred in striking the quarter hour and half hour except for the following differences. Cam follower 31 climbs step 94*a* between the thirty and forty-five minute positions of the minute hand to cock the mechanism for striking the three quarter hour (FIg. 10), and drops off step 94*a* at the forty-five minute position to initiate the striking. Because step 94*a* is slightly higher than step 94*b* latch 74 is pivoted even further away from rack 78 allowing rack teeth 80*a*, 80*b* and 80*c* to pass by, further rotation of rack 78 being arrested by engagement of latch 74 with highest rack tooth 80*d*, said tooth being slightly higher than regular teeth 77 to assure no further rotation of rack 78 at this time. Since three rack teeth (80*a*, 80*b*, 80*c*) have now passed by latch 74, cams 59 and 59*a* will make three complete revolutions before gear 57 is disengaged to stop rotation of these cams. Striking levers 61 and 61*a* will thus strike their respective gong or bell three times, and this indicates the three quarter hour.

Following is the sequence of operations which occurs when striking the hour. As previously noted, snail cam 54 makes one full rotation every 12 hours, and one of its 12 steps is interposed in the path of tab 82 on rack element 81 during each of the twelve respective numbered hours, the radially closest step being interposed just prior to 12 o'clock, and the radially furthest step being interposed just prior to 1 o'clock.

As minute hand shaft 22 rotates with cam 30 between the forty-five minute and one hour positions, cam follower 31 climbs the highest step 94 on cam 30, and slide member 38 is moved further to the left sufficiently to cause its upward extension 73 to pivot lach 74 clear of rack tooth 80*d*. Because tooth 80*d* is the highest tooth on rack 78, latch 74 also clears rack teeth 77 thus completely disengaging latch 74 from rack 78 which is thus released to pivot in a clockwise sense until rack tab 82 engages the interposed step 85 on cam 54 appropriate for the particular approaching hour. Rack 78 is thus cocked to control the striking of the hour (FIG. 11).

When the minute hand shaft reaches the hour, cam follower 31 drops off highest step 94 on can 30 to initiate the striking. Only one striking lever, 61, operates, the structure for preventing lever 61*a* from operating being described below. Cam 59 rotates the same number of times as disc 86 whose rotations equal the number of teeth 77 on rack 78 which tab 87 on disc 86 engages, in turn determined by the particular step 85 on 12-step cam 54 that is interposed in the path of tab 82 on rack 78.

Each rotation of disc 86 and cam 59 results in one complete strike cycle of striking lever 61. Latch 74 was returned to engagment with the teeth on rack 78 when slide member 38 moved to the right, and this engagement prevents clockwise movement of rack 78 (under urging of spring 89) after rack 78 is moved counterclockwise one notch by tab 87 on disc 86.

When rack 78 has been rotated counterclockwise so that lach 74 registers with untoothed peripheral portion 92 of rack 78, tab 90 on rack 78 pushes down on end 91 of the slide member's upward extension 73, thereby disengaging projection 72 from pin 68 and causing arms 55, 56 to be urged by spring 70 to disengage driven gear 57 from constantly rotating gear 67, so that gear 57 stops driving cam 59 and disc 86, thus stopping the striking of striking lever 61 and the turning of rack 78.

Referring again to snail cam 54 (FIG. 5) there is a peripheral indentation 85*a* interposed in the path of rack tab 82 at 12:15, 12:30, and 12-45 o'clock, and a peripheral indentation 85*b* interposed in the path of rack tab 82 at 1:15, 1:30 and 1:45 o'clock. Indentations 85*a*, 85*b* provide clearance for tab 82 during pivotal movement of rack 78 at the above mentioned times. After the 2:00 o'clcok step no additional clearance is required since the remaining steps 85 are indented enough to allow the required rotation of rack 78 at all three quarterly fractions of the hour without rack tab 82 prematurely striking a cam step.

Actually, indentation 85*a* need not be large enough to accommodate rack tab 82 at 12:15 because the 1:00 o'clock step 85 would permit sufficient rotation of rack 78 to allow one strike by each striking lever, even if rack tab 82 abutted the 1:00 o'clock step. Similarly, indentation 85*b* need not be large enought to accommodate rack tab 82 at 1:15 and 1:30 because the 2:00 o'clock step would permit sufficient rotation of rack 78 to allow one to two strikes by each striking lever, even if rack tab 82 abutted the 2:00 o'clock step. However, for simplicity purposes, indentations 85*a*, 85*b* are shown as being sizeable enough to accommodate rack tab 82 at all quarterly fractions of the hour between 12:00 and 1:00 and between 1:00 and 2:00.

In summary, rotation of rack 78 in a clockwise sense, in FIGS. 3 and 8–11, is controlled by both latch 74 and snail cam 54. Latch 74 controls rotations of rack 78 to cock the rack for all quarterly fractions of the hour, and snail cam 54 controls rotation of the rack to cock the rack for each of the full hours; and the snail cam is indented at locations corresponding to quarterly fractions of 1:00 o'clock and 2:00 o'clock to accommodate rotation of the rack beyond the limit at which its rotation is stopped at those full hours.

Following is a description of the structure which prevents striking lever 61*a* from operating during a striking of the hour.

Rotating with minute shaft 22 and cam 30 is a gear 100 (FIGS. 1 and 7) which is in such meshing engagement with minute shaft 22 as to rotate in synchronism with the minute shaft. A lever 102 is pivotally mounted on a pin 103 attached to a support plate 104 fastened to clock movement plate 13. Attached to gear 100 is an arm 101 engaging one end of lever 102 and positioned to move lever 102 outward, in a counterclockwise direction in FIG. 1, as arm 101 rotates.

One end of lever 102 is urged into intimate contact with arm 101 by a spring 105. Connected to lever 102, at an end thereof opposite that acted upon by arm 101, is one end of a pushrod 106 having an opposite end passing through a hole 107 in a projection 110 on striking lever 61*a* (FIG. 7). Pushrod 106 has a formed portion 109 adjacent hole 107 so that movement of the pushrod to the right (FIGS. 1 and 5) will push striking lever 61*a* in a counterclockwise sense (FIG. 5).

Arm 101 is positioned so as to move lever 102 to its furthest counterclockwise position when the minute hand is at the hour position. When this occurs pushrod 106 pushes striking lever 61*a* counterclockwise to a position where the extension 60*a* of lever 61*a* is out of the path of cam 59*a*. Thus, when cams 59 and 59*a* rotate together, only striking lever 61, acted upon by cam 59, will swing back and forth, and that lever alone will strike its respective gong or bell to indicate the hour.

When gear 57 is removed from meshing engagement with constantly rotating gear 67, at the end of the hour striking sequence, shaft 45 and associated cams 59 and 59*a* are free to rotate together beackward in a counterclockwise direction, and, unless restrained, they will rotate backward until their backward motion is arrested by contact with extension 60 of striking lever 61. If shaft 45 and cams 59, 59*a* were allowed to rotate backward to this position, they would not be in the correct position for the beginning of the next quarter hour striking sequence. Structure for preventing this from occurring is described below.

Attached to striking lever 61*a* is a light spring finger 108, so formed as to be in the path of cam 59*a* even when striking lever 61*a* is in its furthest counterclockwise position (FIG. 5). Spring finger 108 is not heavy enough to cause lever 61*a* to be moved by cam 59*a*, but, being in the path of that cam, will prevent rotation of cam 59*a* (and of cam 59) backward in a counterclockwise direction to an undesirable position at the end of the hour striking sequence.

As minute shaft 22 and cam 30 continue to rotate toward the first quarter hour position, gear 100 and associated arm 101 rotate in synchronism. By the time the minute shaft and cam 30 have rotated to the quarter hour position, arm 101 has rotated counterclockwise in FIG. 1 to a position where lever 102, under the urging of spring 105, has pivoted to its furthest clockwise position, thereby retracting pushrod 106 to the left (FIG. 1) and allowing striking lever 61*a* to be returned by spring 64*a* in a clockwise sense until recess 111 on lever 61*a* abuts against rubber stop 44 carried on lever 61. Striking lever 61*a* is now in position to be acted upon by cam 59*a*. Arm 101 is so shaped as to leave lever 102 in its furthest clockwise position (FIG. 1) until the approach of the next hour.

In summary, the above-descirbed striking mechanism will strike a two-note tone at the quarter hour, strike the same two-note twice at the half hour, strike the same two-note tone three times at the three quarter hour, and will then strike a one-note tone at the hour.

The entire mechanism is essentially no more complicated or larger in size than the previously disclosed hour-half-hour striking mechanism of the above noted parent application. A further variation to that mechanism would be to add only the striking lever 61*a* and the cam 59*a*, and the mechanism would then become what is known as a "Bim-Bam"movement, i.e., it would strike a two-note tone on the half hour and a succession of two-note tones on the hour.

The foregoing detailed description has been given for clearness of understanding only, and no unnecessary limitations should be understood therefrom, as modifications will be obvious to those skilled in the art.

What is claimed is:

1. In a clock having an hour hand shaft and a minute hand shaft:

striking means operable to cause a sound;

control means actuable to limit the strikes made by said striking means to a predetermined number of strikes determined by the positions of said hour hand and minute hand shafts;

a constantly rotating gear;

a driven gear;

means mounting said driven gear for movement between a first position, in which said driven gear is in engagement with said constantly rotating gear, and a disengaged second position;

means normally urging said driven gear to said disengaged second position;

means for moving said driven gear to its first position when the minute hand shaft attains the quarter hour, half hour, three quarter hour and hour positions;

drivable means, driven by said driven gear when the latter is in its first position, for operating said striking means and for actuating said control means;

and means, operable by said control means, for returning said driven gear to its disengaged second position when said striking means has struck said predetermined number of strikes.

2. In a clock having an hour hand shaft and a minute hand shaft:

mean for rotating said minute hand shaft through quarter hour, half hour, three quarter hour and full hour positions;

rack means including a toothed periphery;

means mounting said rack means for pivotal movement between a first position and a plurality of positions displaced from said first position in a first pivotal sense;

latch means for engaging with the periphery of said rack means to prevent it from pivoting in said first sense;

means mounting said latch means for movement between (a) a plurality of rack-engaging positions in which said latch means engages the periphery of said rack means and (b) a disengaged position;

latch-biasing means normally urging said latch means toward a rack-engaging position;

means responsive to rotation of the minute hand shaft away from the hour position and toward a position corresponding to one of the three quarterly fractions of the hour for moving said latch means from one to another of its rack-engaging positions against the urging of the latch-biasing means;

rack-biasing means for urging said rack means in said first pivotal sense to a displaced position determined by the particular rack-engaging position of said latch means;

first drivable means, actuable in response to the minute hand shaft attaining a position corresponding to one of said three quarterly fractions of the hour, for returning said rack means to its first position in incremental movements corresponding in number to the particular number of quarters in said quarterly fraction at which said minute hand shaft is then positioned;

striking means operable to cause a sound;

second drivable means for actuating said striking means when said minute hand shaft attains a position corresponding to one of said three quarterly fractions of the hour;

and limiting means for limiting the strikes of said striking means to the number of incremental movements of said rack.

3. In a clock as recited in claim 2 and comprising:

means, responsive to rotation of said minute hand shaft between the three quarter hour and hour positions, for moving said latch means to its disengaged position against the urging of the latch-biasing means;

additional limiting means for limiting pivotal movement of said rack means in said first sense, upon disengagement of said latch means, to a displaced position determined by the position of said hour hand shaft;

said first drivable means comprising means for returning said rack means to its first position, in incremental movements corresponding in number to the particular hour position of said hour hand shaft, when the minute hand shaft attains the hour position;

said second drivable means comprising means for actuating said striking means when said minute hand shaft attains the hour position.

4. In a clock as recited in claim 3:

said additional limiting means comprising a snail cam;

means mounting said snail cam for rotation about its axis;

means for rotating said snail cam through a complete rotation in twelve hours;

said snail cam comprising twelve peripheral steps progressively decreasing in radial distance from the axis of the snail cam, each of said steps corresponding to an hour position of said hour hand shaft;

means on said rack means for engaging one of said cam steps when the rack means pivots in said first pivotal sense and said latch means is in its disengaged position;

and indentation means on the periphery of said snail cam for accommodating said step-engaging means when said rack means pivots in said first pivotal sense and said latch means is in a rack-engaging position.

5. In a clock as recited in claim 3:

said striking means comprising a pair of striking arms;

means mounting each of said striking arms for swinging movement between first and second positions to cause said sound;

means normally urging said striking arms to their first positions;

said second drivable means comprising means for swinging said striking arms;

and means, actuable in response to movement of the minute hand shaft from the three quarter hour to the hour position, for holding one of said striking arms against swinging movement.

6. In a clock as recited in claim 5 and comprising:

means, responsive to the movement of said minute hand shaft between said hour and said quarter hour positions for deactuating said holding means.

7. In a clock as recited in claim 5:

said second drivable means comprising a pair of cam means, each for engaging a respective one of said pair of striking arms, and mutually rotatable together about a common axis to swing the pair of striking arms in a predetermined sequence when the minute hand shaft is at one of its three quarterly hour positions;

said holding means comprising means for holding said one striking arm in its second position;

first means on said one striking arm for engaging its respective cam means, when said one striking arm is in its first position, to maintain said mutually rotatable pair of cam means in a predetermined relation to said pair of striking arms to assure that said pair of striking arms are swung in said predetermined sequence;

and second means on said one striking arm for engaging its respective cam means, when said striking arm is in its second position, to maintain said pair of cam means in said predetermined relation to said pair of striking arms.

8. In a clock as recited in claim 2 wherein:

said limiting means comprising means, responsive to said rack means returning to its first position, for deactuating said first and second drivable means.

9. In a clock as recited in claim 2 wherein:

said rack means comprises, in sequence, an untoothed portion, three partial teeth of sequentially increasing size, and a plurality of full teeth, said sequence extending in a direction opposite said first pivotal sense;

said latch means and said untoothed portion of the rack means being in registry and said latch means engaging the first partial tooth of the rack means when said rack means is in its first position and said latch means is in a first of its rack-engaging positions;

said latch-biasing means comprising means normally urging said latch means to said first rack-engaging position.

10. In a clock as recited in claim 9 wherein:

said means for moving said latch means comprises means, responsive to movement of the minute hand shaft from the hour to the quarter hour position, for moving said latch means, against the urging of said latch-biasing means, to a second rack-engaging position, to permit pivoting of said rack means from its first position to a displaced position in which its second partial tooth is engaged by said latch means.

11. In a clock as recited in claim 9 wherein:

said means for moving said latch means comprises means, responsive to movement of the minute hand shaft from the quarter hour to the half hour position, for moving said latch means, against the urging of said latch-biasing means, to a third rack-engaging position to permit pivoting of said rack means from its first position to a displaced position in which its third partial tooth is engaged by said latch means.

12. In a clock as recited in claim 9 wherein:

said means for moving said latch means comprises means, responsive to movement of the minute hand shaft from the half hour to the three quarter hour position, for moving said latch means, against the urging of said latch-biasing means, to a fourth rack-engaging position to permit pivoting of said rack means from its first position to a displaced position in which its first full tooth is engaged by said latch means.

13. In a clock as recited in claim 12 wherein:

said first full tooth extends further outwardly from the periphery of said rack means than do the other full teeth on said rack means.

14. In a clock as recited in claim 13 wherein:

said means for moving said latch means comprises means, responsive to movement of the minute hand shaft between the three quarter hour and hour positions, for moving said latch means, against the urging of said latch-biasing means, to its disengaged position in which said latch means clears said first full tooth to permit pivoting of said rack means unrestrained by said latch means.

15. In a clock as recited in claim 9 wherein:

said latach-biasing means comprises means, responsive to the return of said rack means to its first position, for urging said latch means to return to its first rack-engaging position.

* * * * *